US005599017A

United States Patent [19]

Bixler et al.

[11] Patent Number: 5,599,017

[45] Date of Patent: Feb. 4, 1997

[54] BASEBALL TARGET AND PROJECTOR APPARATUS

[75] Inventors: Dickie R. Bixler; Matthew R. Bixler, both of Woods County, Okla.

[73] Assignee: Dick Bixler Sports, Inc., Alva, Okla.

[21] Appl. No.: 503,877

[22] Filed: Jul. 17, 1995

[51] Int. Cl.[6] ..... A63B 69/00

[52] U.S. Cl. ..... 473/436; 473/455

[58] Field of Search ..... 273/26 D, 29 A, 273/201; 124/4, 6, 48, 51.1

[56] References Cited

U.S. PATENT DOCUMENTS

| | | | |
|---|---|---|---|
| 1,116,583 | 11/1914 | Garrison . | |
| 1,523,747 | 1/1925 | Bradley . | |
| 1,923,279 | 8/1933 | Cooper | 273/26 R |
| 2,040,228 | 5/1936 | Whiteley . | |
| 2,988,363 | 6/1961 | Hall . | |
| 3,000,636 | 9/1961 | Butler, Jr. . | |
| 3,122,365 | 2/1964 | August . | |
| 3,194,556 | 7/1965 | Vinson . | |
| 3,215,432 | 11/1965 | Lee et al. . | |
| 3,469,840 | 9/1969 | Kruzel . | |
| 3,497,218 | 2/1970 | Johnston . | |
| 3,602,504 | 8/1971 | Chapman . | |
| 3,777,732 | 12/1973 | Holloway | 124/51.1 |
| 3,794,011 | 2/1974 | Newgarden | 124/51.1 |
| 3,822,688 | 7/1974 | Mayne | 124/51.1 |
| 4,025,071 | 5/1977 | Hodges | 273/29 R |
| 4,173,337 | 11/1979 | Okonowski . | |
| 4,220,331 | 9/1980 | Smith | 273/260 |
| 4,275,883 | 6/1981 | Grimaldi | 273/26 A |
| 4,524,749 | 6/1985 | Giovagnoli . | |
| 4,563,005 | 1/1986 | Hand et al. . | |
| 4,655,452 | 4/1987 | Huerstel . | |
| 4,708,343 | 11/1987 | D'Ambrosio . | |
| 4,783,070 | 11/1988 | Bauer et al. . | |
| 4,819,937 | 4/1989 | Gordon . | |
| 4,846,471 | 7/1989 | Haysom . | |
| 4,858,921 | 8/1989 | Eustice et al. . | |
| 4,858,922 | 8/1989 | Santavaci . | |
| 4,871,169 | 10/1989 | Autorino et al. . | |
| 4,877,243 | 10/1989 | Taylor . | |
| 4,915,384 | 4/1990 | Bear . | |
| 5,064,194 | 11/1991 | Bixler et al. . | |

*Primary Examiner*—Theatrice Brown
*Attorney, Agent, or Firm*—Head, Johnson & Kachigian

[57] ABSTRACT

An apparatus for use in practicing the fundamentals of baseball is provided. The apparatus includes an opening for accepting and capturing baseballs thrown at the apparatus. The opening is covered by a number of vertical flaps, behind which is a padded backstop. The flaps are colored appropriately to designate a typical strike zone. A pitchback machine is provided to propel baseballs from the apparatus. A ball holding tray is positioned beneath the opening and backstop to accumulate thrown balls or to retain a reservoir of balls. A motor-driven spinner plate is situated integral to the holding tray for circulating the balls resting therein and for facilitating the movement of the balls to an outlet path. The holding tray outlet path leads to a motor-driven helical auger. The auger conveys the balls from the outlet path to the pitchback machine. The apparatus may include a channel member adapted to receive balls from the auger, the channel member having a shut off switch for controlling a flow of balls down its length. An adjustable ball stop is positioned adjacent to the channel member at a distance sufficient for presenting the balls to the pitchback machine. The driven components of the apparatus, including the shut off switch and auger, are electrically coordinated such that when one ball is released down the channel member to the pitchback machine, the auger is activated so as to convey another ball to the channel member. The apparatus may also be supported upon a transportable frame for ready movement from one location to another.

7 Claims, 4 Drawing Sheets

BASEBALL TARGET AND PROJECTOR APPARATUS

BACKGROUND OF THE INVENTION

A popular game in the United States, Japan, Cuba and other countries of the world is baseball. Most of the action in a baseball game involves pitching, hitting and fielding. The rules require that the pitcher pitch the baseball within an imaginary strike zone over a plate, termed a "home plate". Any pitch that does not pass through the strike zone is called a "ball," and if four balls are pitched to a single batter the batter is allowed to go to first base without putting the ball in play by striking it with a bat. The strike zone is a rectangular area defined by a width equal to the width of home plate (17 inches), a lower edge that is an imaginary line drawn at the knees of the batter, and an upper edge that is an imaginary line drawn just below the shoulders of the batter (although in practice rarely is any pitch above the batter's waist called a strike). Thus, when considering the distance from the pitcher's mound to the batter's box, the strike zone is a relatively small rectangular area through which a ball must pass. A pitcher capable of consistently throwing a ball at a high speed through a strike zone is in great demand by schools and by professional baseball teams. For this reason, a large number of young athletes spend considerable time perfecting baseball pitching skills.

Persons with advanced hitting and fielding skills also have opportunities in baseball. Both hitting and fielding require precise hand/eye coordination best developed through repetition. To practice hitting, baseballs must be repeatedly pitched to the batter. Likewise, to practice fielding baseballs must be repeatedly propelled toward the fielder.

Heretofore, various devices and machines have been invented for aiding the development of those skills necessary for baseball. These devices include Applicants' Apparatus for Use in Practicing Pitching of Baseballs, disclosed and claimed in U.S. Pat. No. 5,064,194, the disclosure of which is incorporated herein by reference.

Applicants' prior machine enables the user to improve pitching accuracy by indicating whether pitched balls are delivered within a strike zone. The apparatus has a vertical backboard with a rectangular opening therethrough, four trapezoidal shaped wings secured to the backboard that serve to form an opening defining a strike zone, each of the wings being pivotal when engaged by a baseball, electrical contacts activated as each trapezoidal wing is pivoted when struck by a baseball, and electrical indicators for signaling when a baseball strikes one of the trapezoidal wings to indicate that the baseball has been pitched high, low, inside or outside of the strike zone.

In one of its preferred embodiments, the prior apparatus includes a pitchback machine configured to return balls that have passed through the strike zone back to the pitcher. A pitched ball passing through the strike zone opening enters a catcher box. From there the ball moves via gravity flow downward to the pitchback machine. The pitchback machine picks up the ball and throws it through a pitchback opening.

A pitchback machine may also be used to throw a baseball to a batter or to propel a baseball toward a fielder. While suitable for its intended usage of improving pitching accuracy, the prior apparatus, and more specifically the configuration of the catcher box and the pitchback machine, is not adequate to propel a high volume of baseballs to a practicing batter or fielder.

It is thus an object of this invention to advance the field of baseball training aids so that a player may easily practice all aspects of the game—pitching, hitting and fielding—utilizing a single machine capable of handling a high volume of baseballs.

SUMMARY OF THE INVENTION

The present invention improves the prior art in that it may be used to practice pitching, hitting and fielding because of its ability to competently manage a high volume of baseballs. In its preferred embodiment, the apparatus includes an opening for accepting and capturing baseballs thrown at the apparatus. The opening is covered by a number of vertically oriented flaps, behind which is positioned a padded backstop. The flaps are colored appropriately to designate a typical strike zone. A pitchback machine is provided to propel baseballs from the apparatus.

A ball holding tray is positioned beneath the opening and backstop to accumulate thrown balls or to retain a reservoir of balls. A motor-driven spinner plate is situated integral to the holding tray for circulating the balls resting therein and for facilitating the movement of the bails to an outlet path. The holding tray outlet path leads to a motor-driven helical auger. The auger conveys the balls in a managed fashion from the outlet path to the pitchback machine.

In connection with other aspects of the invention, the apparatus may include a staging channel member adapted to receive balls from the auger, the channel member having a shut off switch for controlling a flow of balls down its length. An adjustable ball stop is positioned adjacent to the channel member at a distance sufficient for presenting the balls to the throw arm of the pitchback machine. The driven components of the apparatus, including the shut off switch and auger, are electrically coordinated such that when one ball is released down the channel member to the pitchback machine, the auger is activated so as to convey another ball to the channel member. A remote control means is included.

The apparatus may also be supported upon a transportable frame for ready movement from one location to another.

The features of the apparatus allow it to be used for practicing pitching, hitting and fielding. To practice pitching, the apparatus is set at home plate. The pitcher then directs the pitches to the colored strike zone shown on the face of the vertical flaps that cover the opening. The pitched balls are captured by the apparatus and fall onto the holding tray. They are then moved to the pitchback machine, as explained above, which tosses the balls back to the pitcher.

For hitting practice, the apparatus is placed at the pitcher's mound and the holding tray is loaded with balls. The apparatus may be set so that the pitchback machine throws a pitch at a given time interval. When turned on, the pitchback machine begins to deliver balls, one at a time, to the hitter. As a ball is pitched, another ball is presented to the pitchback machine via the delivery system described above.

To practice fielding, the apparatus is positioned wherever appropriate to direct baseballs to the fielder. Again, the apparatus may be set so that the pitchback machine propels a ball toward the fielder at a given time interval. When turned on, the pitchback machine begins to deliver balls, one at a time, to the fielder. After fielding the ball, the fielder throws the ball back to the apparatus, directing the throw to the colored portion of the vertical flaps.

The apparatus efficiently manages a large volume of baseballs without jamming or failing, thus providing needed repetitions to the practicing player without interruption.

Still other objects and advantages of the present invention will become readily apparent to those skilled in this art from the following detailed description, wherein there is shown and described only the preferred embodiment of the invention, simply by way of illustration of the best mode contemplated for carrying out the invention. As will be realized, the invention is capable of modifications in various obvious respects, all without departing from the invention. Accordingly, the description should be regarded as illustrative in nature, and not as restrictive.

DETAILED DESCRIPTION OF THE PREFERRED EMBODIMENT

Figure 1:
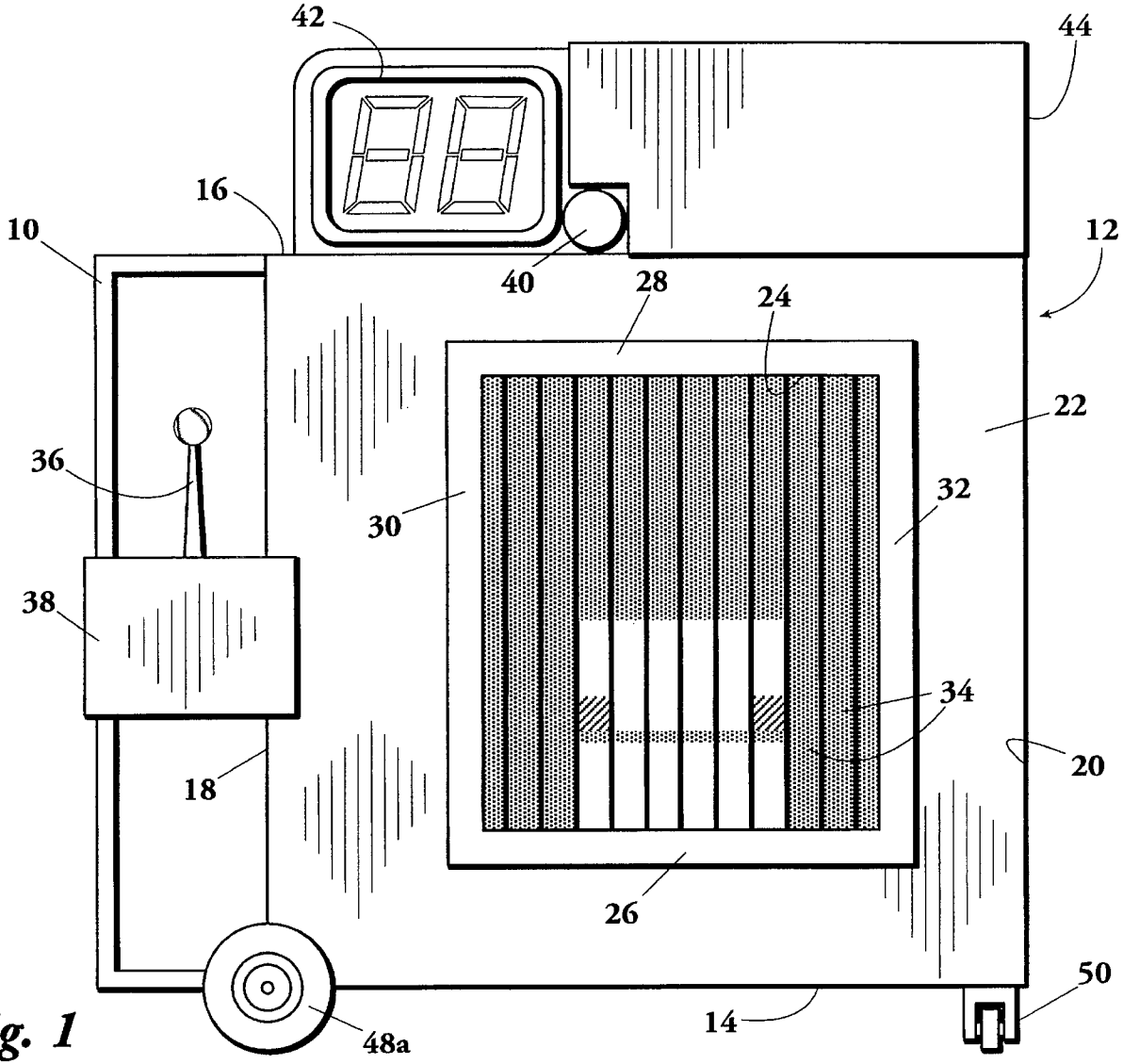
FIG. 1 is a front view of the preferred embodiment of the invention.

Referring to FIG. 1, an embodiment of the invention is illustrated. The apparatus includes a frame 10 upon which is supported a vertical backboard member 12. Backboard member 12 has a bottom edge 14, a top edge 16, a first vertical edge 18 and a second vertical edge 20. The backboard member 12 may be made of metal, wood, plastic or fiberglass and may typically be about six feet high and six to eight feet long, although these dimensions can vary considerably. The backboard member 12 is preferably covered with a padded facing 22.

Formed in the backboard member 12 is an opening 24 having a bottom horizontal edge 26, a top horizontal edge 28, a first vertical edge 30 and a second vertical edge 32. Covering the forward portion of the opening 24 is a plurality of vertical flaps 34. The vertical flaps 34 are colored so as to indicate an area corresponding to a typical strike zone. The vertical flaps 34 may be rubber strips or strips of any material with properties that allow for the passage of a thrown baseball through opening 24. The function of vertical flaps 34 is to provide the practice player a target for throwing and to prevent thrown baseballs from rebounding out of opening 24.

Also visible in FIG. 1 is the throw arm 36 of the pitchback machine (not shown in FIG. 1). The throw arm 36 is positioned between the frame 10 and the first vertical edge 18 of backboard member 12. This allows for baseballs to be propelled from the pitchback machine to the practice player. A protective cover 38 extends forward of throw arm 36.

The apparatus may also be equipped with a radar gun 40, displaying the speed of a pitched ball at indicator 42. An upper padded facing 44 protects an area above backboard member 12 that may be used for other indicators or functional components.

The preferred practice apparatus of this disclosure is transportable, and for this reason the frame 10 is constructed of a relatively lightweight material, such as square metal tubing. An axle 46 (shown in FIG. 3) having wheels 48*a–b*, along with one or more rollers 50 enables the apparatus to be moved from one location to another. A trailer hitch (not shown) may be affixed by a structural member to the frame 10 for vehicular movement. When the device is designed to be moved long distances by being pulled behind a vehicle, such as a car, pick-up, or the like, larger wheels may be provided to accept highway speeds.

Figure 2:
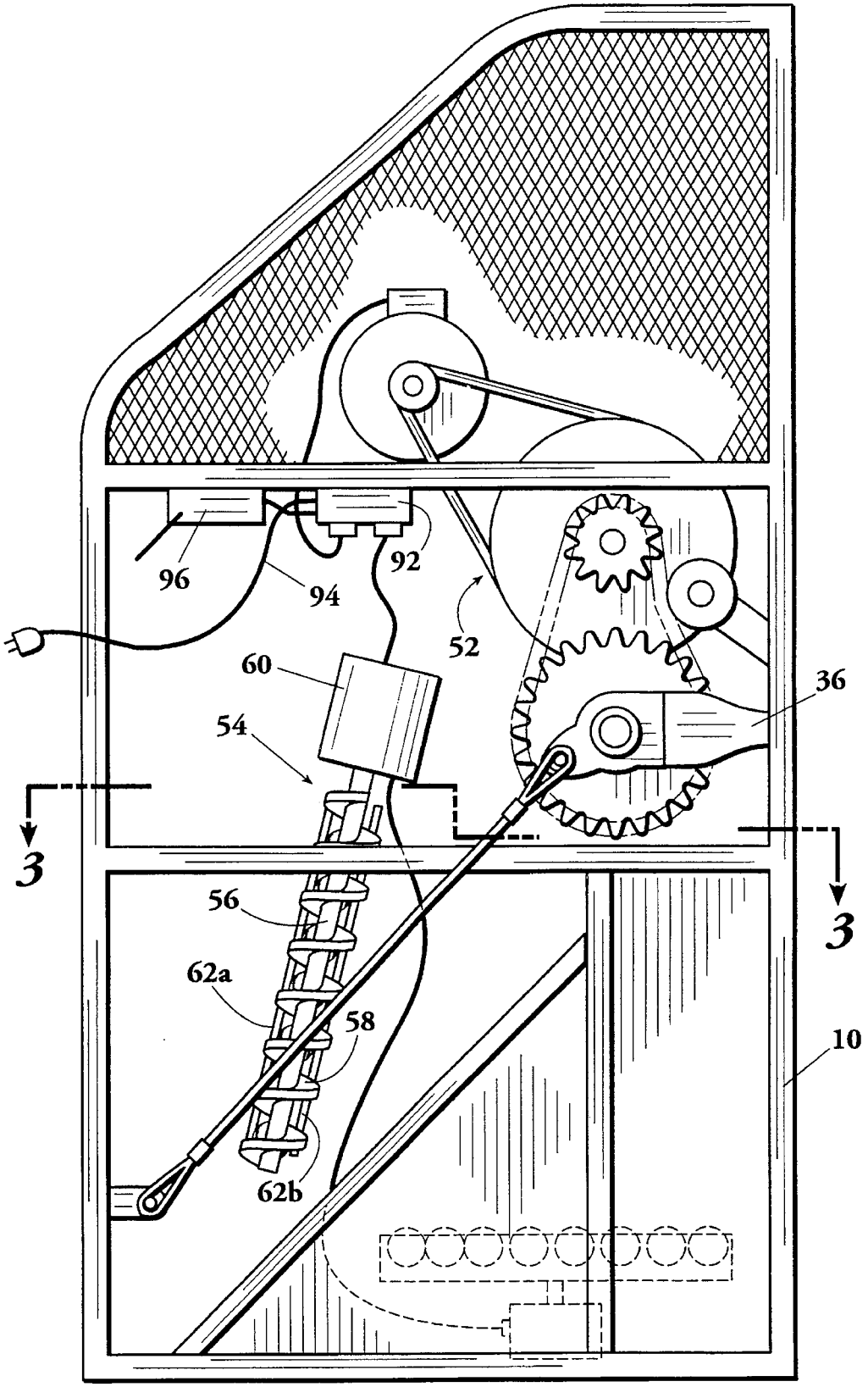
FIG. 2 is a partial side view of the preferred embodiment showing the auger mechanism and a portion of the pitchback machine.

Shown partially in FIG. 2 is a pitchback machine, generally indicated by the reference numeral 52. Such machines are well-known and frequently employed in pitching or batting practice devices and function to manipulate a throw arm 36 that picks up and propels a ball. The pitchback machine 52 comprises a number of pulleys, gears, cables and springs that work in concert to whip throw arm 36 to impart high velocities upon a baseball. The pitchback machine 52 is driven by pitchback machine motor 53. The speed at which a baseball is propelled from pitchback machine 52 is adjustable by the user. Many different arrangements of structural components comprising a pitchback machine are compatible with the present invention.

Also shown in more detail in FIG. 2 is frame 10 and the construction and depth thereof. Positioned within frame 10 and near the pitchback machine 52 is an auger means, generally indicated by the reference numeral 54 (see also FIG. 6). The auger means 54 preferably comprises an auger shaft 56 having a single helical blade 58. The function of the auger means 54 is to transport captured baseballs to the pitchback machine 52. A motor 60 drives auger shaft 56 such that baseballs are moved upward by blade 58 toward motor 60. Two side rails 62*a–b* contain the baseballs within the circumference of auger shaft 56.

Figure 3:
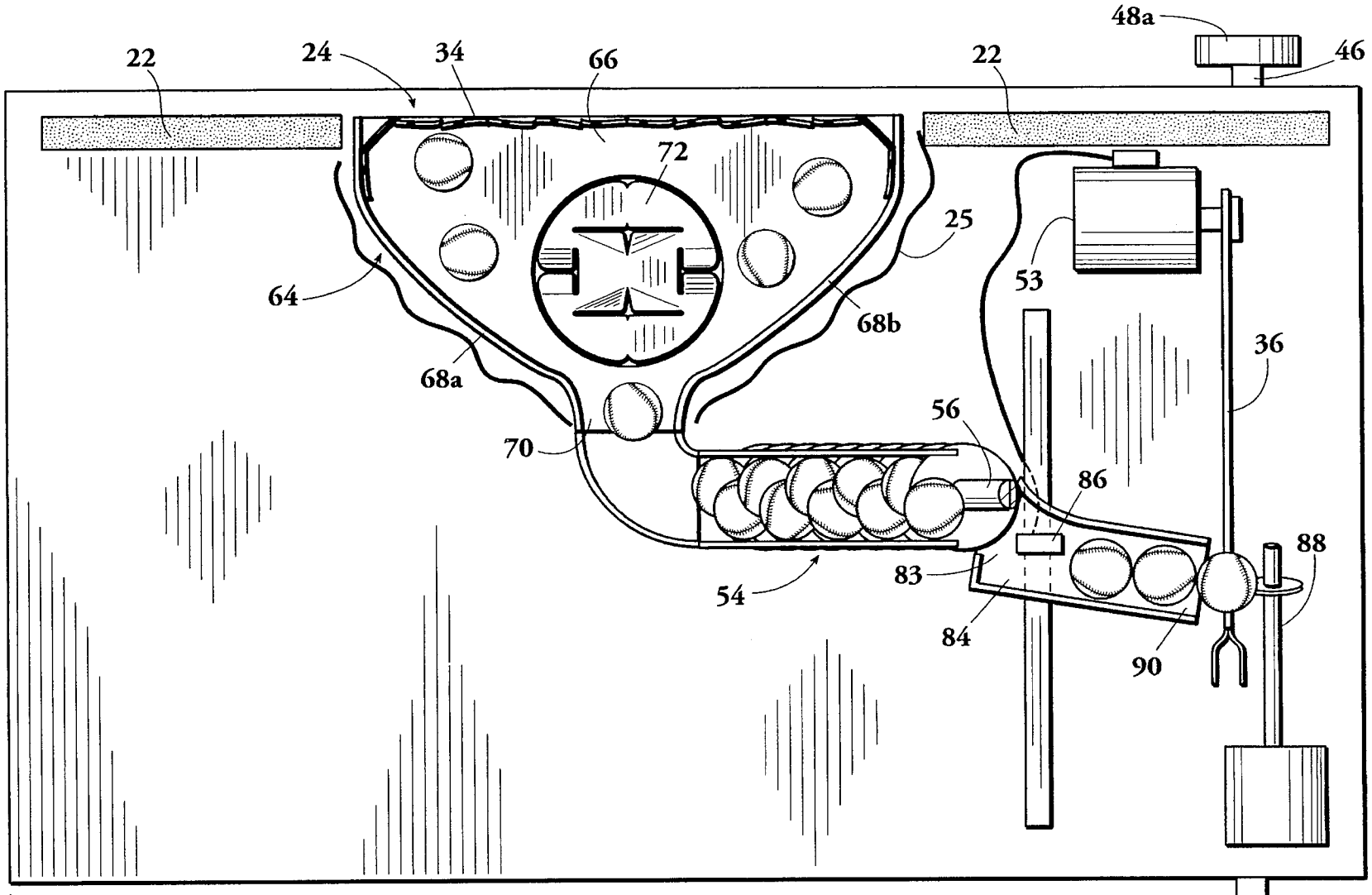
FIG. 3 is a sectional view taken along line 3—3 of FIG. 2.

FIG. 3 is a sectional view taken along line 3—3 of FIG. 2 showing certain inventive components of the apparatus. Between the two sections of padded facing 22 is opening 24 covered by vertical flaps 34. At the bottom of opening 24 is a ball holding tray 64. The ball holding tray 64 has a horizontal floor portion 66 and two vertically raised side edges 68*a–b*. The side edges 68*a–b* converge toward the rear of the apparatus to form an outlet path 70. A padded backstop 25 serves to stop balls entering opening 24 so that they drop onto holding tray 64.

An agitating means 72 is positioned integral to the floor portion 66 of the holding tray 64. The agitating means 72 circulates a reservoir of balls resting upon floor portion 66 and aids in directing the balls to outlet path 70, to thus prevent jamming.

Figure 4:
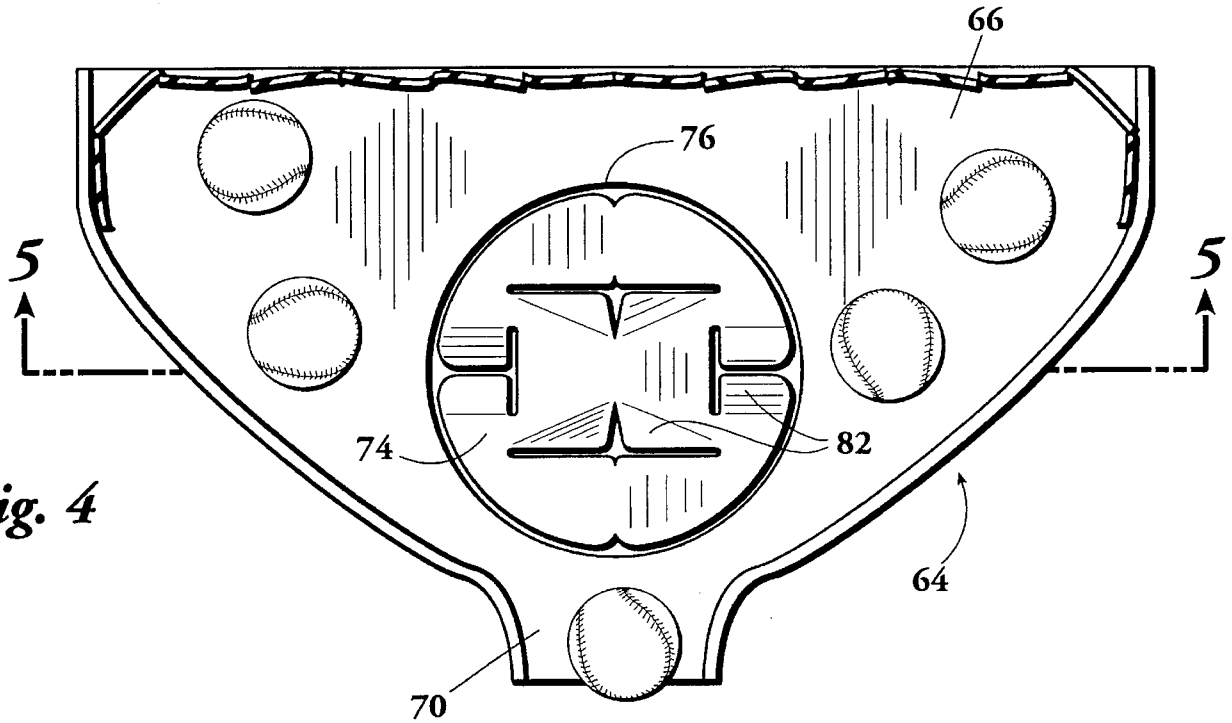
FIG. 4 is a top plan view of the ball holding tray and related components.
Figure 5:
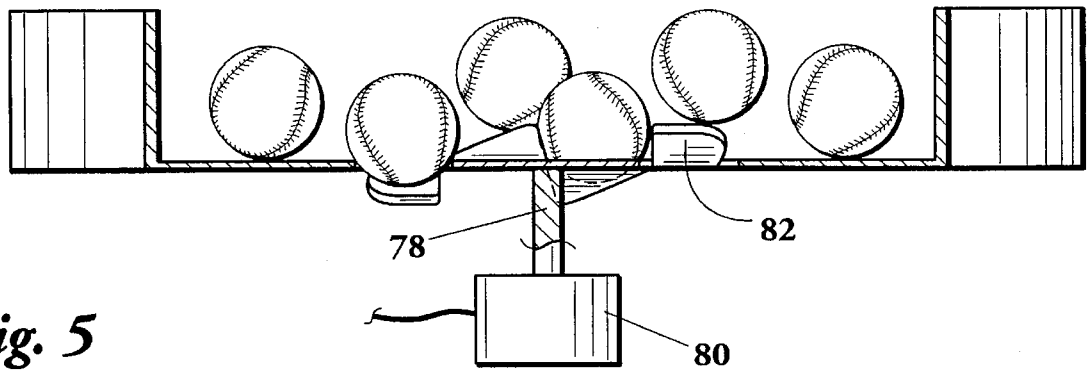
FIG. 5 is a sectional view taken along line 5—5 of FIG. 4.

Preferably, the agitating means 72 comprises a motor driven spinner plate having a plurality of upturned flanges arranged thereon. FIGS. 4 and 5 better show the motor driven spinner plate of the present invention.

Referring to FIGS. 4 and 5, the spinner plate 74 is circular in nature and is seated within a complementary circular aperture 76 formed in the floor portion 66 of holding tray 64. A drive shaft 78 extends downwardly from the bottom of spinner plate 74 to connect to a spinner plate motor 80. A plurality of flanges 82 are arranged upon the upper surface of the spinner plate 74 so as to agitate the balls resting on the floor portion 66 of holding tray 64. When engaged, spinner plate 74 circulates the balls resting within holding tray 64 to facilitate the movement of the balls toward outlet path 70.

Referring back to FIG. 3, the outlet path 70 runs from holding tray 64 to the lower end of auger means 54. Upon rotation of the auger shaft 56 the balls are moved upward toward a channel member 84. The baseballs exit the auger means 54 one at a time and roll onto the forward end 83 of channel member 84. The channel member 84 is provided with a shut off switch 86 that controls a flow of balls down the channel member 84. The channel member 84 is downwardly inclined so that when shut off switch 86 is engaged a ball will roll toward the terminal end 90 of channel member 84 and come to rest against an adjustable ball stop 88. Ball stop 88 is positioned at a distance from the terminal end 90 of channel member 84 sufficient for presenting the ball to the throw arm 36 of the pitchback machine 52.

Figure 6:
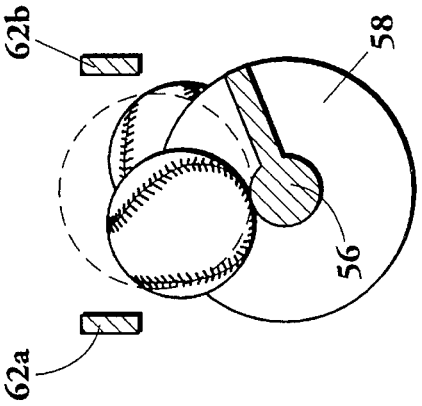
FIG. 6 is a top cross sectional view of the preferred auger mechanism.

The holding tray 64, outlet path 70, auger means 54, channel member 84 and adjustable ball stop 88 all accommodate regulation sized baseballs or softballs. (Shown in a phantom view in FIG. 6 is the circumference of a regulation softball.) The only adjustment that need be made to convert the apparatus to and from baseball and softball modes is to adjust ball stop 88 so that throw arm 36 is properly positioned for the size ball being used.

The components of the invention are electrically connected so that their movements are coordinated to provide a managed flow of baseballs to the throw arm 36 of pitchback machine 52. Referring to FIGS. 2, 3 and 5, a main electrical control box 92 is positioned adjacent to a portion of frame 10. A cord 94 having a standard 110 volt plug end provides power to control box 92. A remote control means 96 is electrically connection to control box 92. Both auger motor 60 and pitchback machine motor 53 plug into control box 92 via standard 110 volt connections. The spinner plate motor 80 is powered through a connection with auger motor 60.

The operation of the various motors is managed through the circuitry of control box 92. The auger motor 60 is intermittently engaged as needed to provide a flow of baseballs to channel member 84, while the spinner plate motor 80 is similarly engaged to circulate the balls in holding tray 64. Either a timer is set by the user to maintain an interval between rotations of the throw arm 36 of the pitchback machine 52, or the user may manually control the apparatus through remote control box 96. The shut off switch 86 is electrically manipulated through coordination with the pitchback machine motor 53 to allow for the passage of a ball from the forward end 83 of channel member 84 to the terminal end 90 of channel member 84. After a ball is thrown by the pitchback machine 52, shut off switch 86 is engaged to allow a ball to travel down channel member 84. At this time, the auger motor 60 is momentarily engaged such that another ball is placed at the forward end of channel member 84.

The apparatus thus described provides a convenient system for use by a player to practice pitching, hitting and fielding baseballs and softballs in the manner described above.

While the invention has been described with a certain degree of particularity, it is manifest that many changes may be made in the method hereinabove described without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An apparatus for practicing the fundamentals of baseball, comprising:

(a) a target area receiving means for accepting and securing baseballs thrown at said apparatus;

(b) pitchback means for propelling baseballs from said apparatus;

(c) a ball holding tray located beneath said receiving means, said ball holding tray having an outlet path;

(d) an agitating means positioned integral to said holding tray for circulating a plurality of balls resting therein and directing said balls to said outlet path;

(e) an auger means for conveying said balls from said outlet path to said pitchback means;

(f) a channel member adapted to receive said balls from said auger means, said channel member having a shut off switch for controlling a flow of said balls down said channel member;

(g) an adjustable ball stop positioned adjacent to said channel member at a distance sufficient for presenting said balls to said pitchback means; and (h) a means for communicating with and controlling said shut off switch and said auger means such that when one of said balls is released down said channel member, said auger means is activated so as to convey another of said balls to said channel member; and (i) a transportable frame for supporting said apparatus.

2. The apparatus according to claim 1, wherein said target area receiving means comprises an opening covered by a plurality of vertically oriented flaps and a means to impede said baseballs after passage through said opening.

3. The apparatus according to claim 2, wherein said means to impede said baseballs comprises a padded backstop.

4. The apparatus according to claim 1, wherein said agitating means comprises a motor-driven spinner plate.

5. The apparatus according to claim 4, wherein said spinner plate has a plurality of upturned flanges arranged thereon.

6. The apparatus according to claim 1, wherein said auger means comprises a motor-driven auger shaft having a single helical blade and a pair of auger shaft side rails for containing said balls upon said auger shaft.

7. An improved baseball practice apparatus of the type having a means for receiving thrown baseballs and a pitchback means for propelling baseballs from said apparatus, wherein the improvement comprises:

(a) a target area positioned proximate said receiving means;

(b) a ball holding tray located beneath said receiving means, said ball holding tray having an outlet path;

(c) a motor-driven spinner plate having a plurality of upturned flanges arranged thereon positioned integral to said holding tray for circulating a plurality of balls resting therein and directing said balls to said outlet path;

(d) a motor-driven auger shaft for conveying said balls from said outlet path to a channel member, said channel member having a shut off switch for controlling a flow of said balls down said channel member;

(e) an adjustable ball stop positioned adjacent to said channel member at a distance sufficient for presenting said balls to said pitchback means;

(f) a means for communicating with and controlling said release latch and said auger shaft such that when one of said balls is released down said channel member, said auger means is activated so as to convey another of said balls to said channel member; and (g) a transportable frame for supporting said apparatus.

* * * * *